US006705059B2

(12) United States Patent
Romes

(10) Patent No.: US 6,705,059 B2
(45) Date of Patent: Mar. 16, 2004

(54) ROLLED FABRIC CARRIAGE APPARATUS

(75) Inventor: Gary E. Romes, Cincinnati, OH (US)

(73) Assignee: Guardian Fiberglass, Inc., Albion, MI (US)

( * ) Notice: Subject to any disclaimer, the term of this patent is extended or adjusted under 35 U.S.C. 154(b) by 12 days.

(21) Appl. No.: 09/963,582

(22) Filed: Sep. 27, 2001

(65) Prior Publication Data

US 2003/0056464 A1 Mar. 27, 2003

(51) Int. Cl.[7] ..... E04D 15/00; E04F 21/00; E04G 21/14

(52) U.S. Cl. ..... 52/749.12; 52/746.11; 52/745.13; 242/566

(58) Field of Search ..... 52/742.12, 746.11, 52/746.1, 749.12, 745.06, 745.13; 242/566, 590, 588, 588.3, 588.6

(56) References Cited

U.S. PATENT DOCUMENTS

| | | | |
|---|---|---|---|
| 1,587,842 | A | 6/1926 | Knox |
| 2,041,910 | A | 5/1936 | Ericson |
| 2,587,985 | A | 4/1952 | Elmendorf |
| 2,861,525 | A | 11/1958 | Curtis et al. |
| 3,121,649 | A | 2/1964 | Oliver |
| 3,135,070 | A | 6/1964 | Waring et al. |
| 3,307,306 | A | 3/1967 | Oliver |
| 3,559,914 | A | 2/1971 | Alderman |
| 3,619,437 | A | 11/1971 | McDonald |
| 3,662,509 | A | 5/1972 | Studzinski |
| 3,694,306 | A | 9/1972 | Fricklas |
| 3,729,879 | A | 5/1973 | Franklin |
| 3,735,538 | A | 5/1973 | Ramins |
| 3,835,604 | A | 9/1974 | Hoffman, Jr. |
| 3,845,602 | A | 11/1974 | Alderman |
| 3,861,616 | A | 1/1975 | Dubberke |
| 3,969,863 | A | 7/1976 | Alderman |
| 4,014,150 | A | 3/1977 | Wells et al. |
| 4,031,681 | A | 6/1977 | Charniga |
| 4,047,345 | A | 9/1977 | Alderman |
| 4,047,346 | A | 9/1977 | Alderman |
| 4,050,972 | A | 9/1977 | Cardinal, Jr. |
| 4,075,807 | A | 2/1978 | Alderman |
| 4,147,003 | A | 4/1979 | Alderman |
| 4,151,692 | A | 5/1979 | Holcombe |
| 4,213,282 | A | 7/1980 | Heckelsberg |
| 4,222,212 | A | 9/1980 | Alderman |
| 4,233,791 | A | 11/1980 | Kuhl et al. |
| 4,296,581 | A | 10/1981 | Heckelsberg |
| 4,303,713 | A | 12/1981 | Clemensen et al. |
| 4,329,823 | A | 5/1982 | Simpson |
| 4,333,291 | A | 6/1982 | Musgrave et al. |
| 4,333,292 | A | 6/1982 | Musgrave |

(List continued on next page.)

OTHER PUBLICATIONS

Dispense–R Insulation System by Thermal Design, 1998.
Perfect R, The Perfect Solution for Every Job, CGI Silvercote Inc.
Owens–Corning Elaminator Sales and Instruction Training Video, 100 Series, 1994.
Owens–Corning Elaminator Insulation System, 1996.
Owens–Corning System Thinking Advertisement, 1998.

*Primary Examiner*—Carl D. Friedman
*Assistant Examiner*—Chi Q. Nguyen
(74) *Attorney, Agent, or Firm*—Hall, Priddy, Myers & VandeSande

(57) ABSTRACT

Apparatus which is capable of rotatably carrying a fabric roll in a vertical orientation and which is movably attachable to an element of a known fabricated wall structure. In particular, such apparatus is useful in the practice of dispensing a sheet of vapor retarding fabric when constructing insulated fabricated wall structures.

23 Claims, 6 Drawing Sheets

U.S. PATENT DOCUMENTS 4,361,993 A 12/1982 Simpson
4,391,075 A 7/1983 Musgrave
4,393,634 A 7/1983 McDermott et al.
4,446,664 A 5/1984 Harkins
4,446,665 A 5/1984 Berger
4,528,789 A 7/1985 Simpson
4,528,790 A 7/1985 Lo et al.
4,557,092 A 12/1985 Brueske
4,566,239 A 1/1986 Smigel et al.
4,602,468 A 7/1986 Simpson
4,635,423 A 1/1987 Ward
4,637,188 A 1/1987 Crothers
4,699,484 A 10/1987 Howell et al.
4,709,523 A 12/1987 Broderick et al.
4,711,407 A 12/1987 Boon
4,736,552 A 4/1988 Ward et al.
4,967,535 A 11/1990 Alderman
5,195,764 A 3/1993 Schantz et al.
5,491,952 A 2/1996 Alderman et al.
5,495,698 A 3/1996 Alderman et al.
5,551,203 A 9/1996 Alderman et al.
5,561,959 A 10/1996 Alderman et al.
5,653,081 A 8/1997 Wenrick et al.
5,653,083 A 8/1997 Alderman et al.
5,664,740 A 9/1997 Alderman et al.
5,685,123 A 11/1997 Alderman et al.
5,720,147 A 2/1998 Wenrick et al.
5,746,077 A 5/1998 Zaccagni
5,784,966 A 7/1998 Brown et al.
5,921,057 A 7/1999 Alderman et al.
6,247,288 B1 * 6/2001 Harkins ..... 52/746.11

* cited by examiner

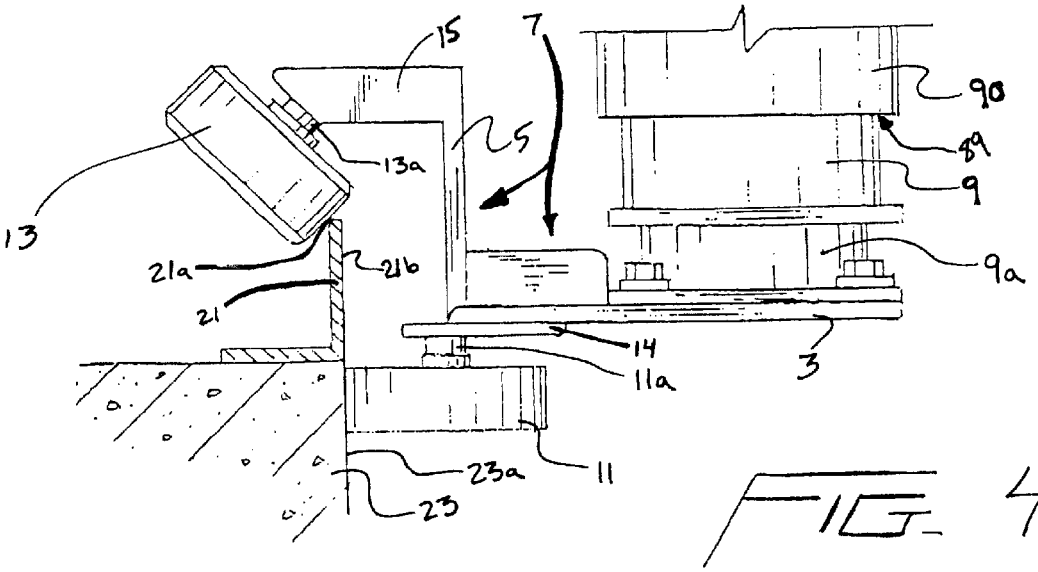
FIG. 4A
FIG. 4B
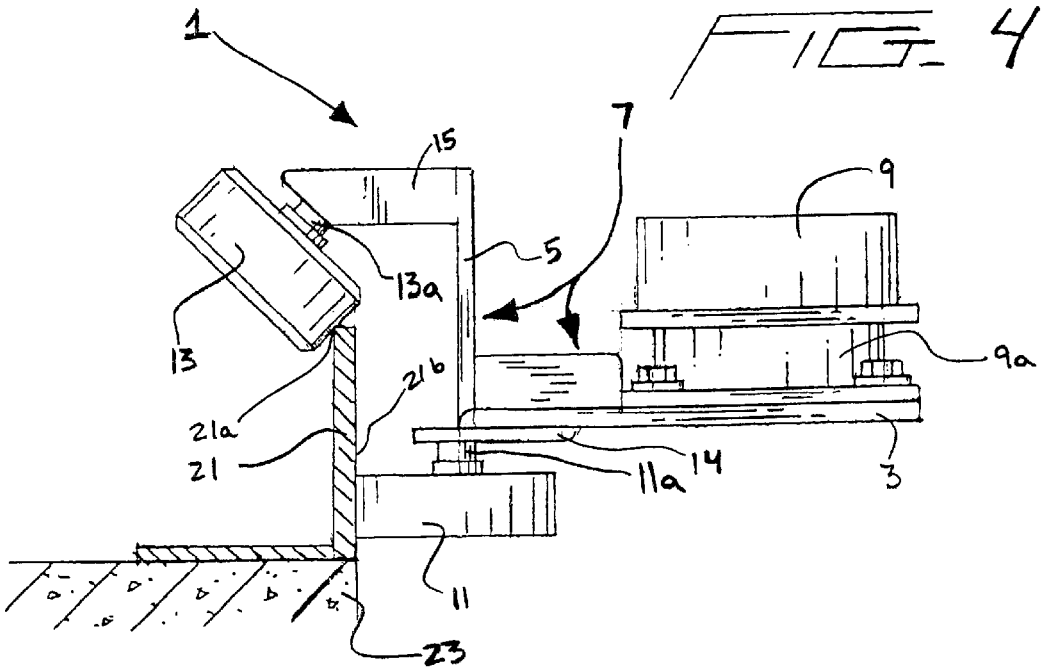

ROLLED FABRIC CARRIAGE APPARATUS

FIELD OF INVENTION

This invention relates to apparatus which is capable of rotatably carrying a fabric roll in a vertical orientation along an element of a known fabricated wall structure. More specifically, this invention relates to apparatus which is useful in the practice of dispensing a sheet of vapor retarding fabric when constructing insulated fabricated wall structures.

BACKGROUND OF INVENTION

In the fabricated building art, it has been known to construct and insulate roof and wall structures utilizing various methods and apparatus such as is disclosed in my U.S. patent application Ser. No. 09/511,305 filed February 23, 2000, now U.S. Pat. No. 6,308,489, which discloses apparatus for dispensing a layer of fabric along a frame of a wall structure (as well as on roof structures). Such layer of fabric typically serves as a support layer for a thickness of insulation and often as a vapor barrier to prevent moisture from penetrating the various spaces and materials of the wall (or roof) structure.

Fabricated wall structures are conventionally comprised of a series of wall studs or columns extending vertically from a cement foundation with various girts or purlins mounted on the outside facing surface substantially perpendicular thereto (i.e. in a substantially horizontal fashion). A typical spacing of these girts is approximately 5 feet from centerline to centerline, however any desired spacing may be employed. Typically located at the bottom of the wall structure, usually attached, in known fashion, to the foundation of the building, is a base angle which is conventionally L-shaped with a horizontally extending base portion and a vertically extending back portion oriented at a right angle to the base portion. The base portion of the "L" is typically attached flush with the horizontal surface of the foundation with the vertical portion of the "L" usually being oriented in-line with the vertical edge of the foundation. Located as such, the vertical portion of the base angle provides a surface to which metal wall panels may be attached such as by screws or other mechanical means. Typically, there is a space between the upper most edge of the base angle and the first girt (or purlin), the size of such space approximating the distance between any two girts or purlins.

In order to insulate such a conventional wall structure, it is known to first dispense a layer of fabric (e.g. such as a high-density-woven-polyethylene) over the outermost surface of the girts (i.e. the surface which would normally face the outside of the building). After securing at least a first (i.e. trailing) end of the fabric, batts of insulation are placed on top of this fabric layer and a layer of wall panels (e.g. metal sheeting) placed thereover. Once the metal sheeting is in place, the metal sheeting is secured or fixed to the girts and base angle of the wall structure using mechanical means such as conventional fastening screws.

In order to facilitate efficient construction and insulation of such a wall structure, apparatus may be used such as described in U.S. patent application Ser. No. 09/511,305 to secure a fabric roll against the framework of the wall structure (i.e. the girts) as the fabric is being dispensed. Apparatus for this purpose are particularly important in fabricating insulated walls because of the rather large size and weight of fabric rolls and their rather unwieldy nature when positioned in vertical orientations. Known wall dispenser apparatus, however, only secure the fabric rolls so as to prevent the fabric rolls from falling away from the wall frame and do not provide support for rolls at their bottom most ends (i.e. they are incapable of supporting fabric rolls above ground or foundation level). Therefore, without further apparatus to aid in vertically carrying a fabric roll, the roll will remain in contact with the ground (if not otherwise carried, for example) and may only be advanced along the length of the wall with much difficulty and with possible damage to the end of the roll from contact with rocks or other abrasive materials or surfaces.

One attempt to solve the above described problem is disclosed and illustrated in the above-referenced pending patent application. In this attempt to solve the prior art problem, a ball is inserted into the core of the bottom most end of the fabric roll thus providing a surface for contact with the ground. This ball, then, supports substantially the entire weight of the fabric roll and aids in the movement of the roll around the perimeter of the building structure. Although useful, such a ball has its own disadvantages. In particular, one problem associated with the use of such device is that if a relatively flat or even surface is not encountered by the ball structure, a roll of fabric may not be advanced in a smooth, trouble free manner. In this respect, such ball type devices require a substantially smooth ground surface surrounding the foundation of the building if they are to be effective at all. Because such a smooth ground surface is needed, valuable time and effort must be expended in order to clear the areas surrounding the building of rocks and other obstructing debris.

In view of the above, it is apparent that there exists a need in the art for apparatus which overcomes the above drawbacks. It is a purpose of this invention to fulfill this need in the art, as well as other needs which will become apparent to the skilled artisan once given the above disclosure.

SUMMARY OF INVENTION

Generally speaking, this invention fulfills the above-described needs in the art by providing: a carriage apparatus for carrying a roll of fabric as the roll of fabric is being dispensed along a wall structure, the carriage apparatus comprising:

- a first frame member;
- a second frame member extending at a first angle from the first frame member;
- means for rotatably carrying a fabric roll in a substantially vertical orientation, the mean for rotatably carrying a fabric roll located proximal a first surface of the first frame member;
- first means for contacting a first surface of a building element, the first means located proximal a second surface of the first frame member;
- second means for contacting a second surface of the same or a different building element, the second means located proximal a first surface of the second frame member; and
- wherein the first and second means for contacting, in combination, are capable of cooperating with at least one element of a building structure such that the carriage apparatus will be moveably engaged to the at least one element In another embodiment there is provided: a carriage apparatus for carrying a roll of fabric as the roll of fabric is being dispensed along a wall structure, the carriage apparatus comprising:

- a first frame member having a first and a second surface;
- a second frame member extending at a first angle from the first frame member;
- a rotatable carrying member attached proximal the first surface of the first frame member and being capable of supporting a roll of fabric in a vertical orientation;

a first contacting member attached proximal the second surface of the first frame member;

a second contacting member attached proximal a first surface of the second frame member;

wherein the first and second contacting members, in combination, are capable of cooperating with at least one element of a building structure such that the carriage apparatus will be moveably engaged to the at least one element

IN THE DRAWINGS

Figure 3:
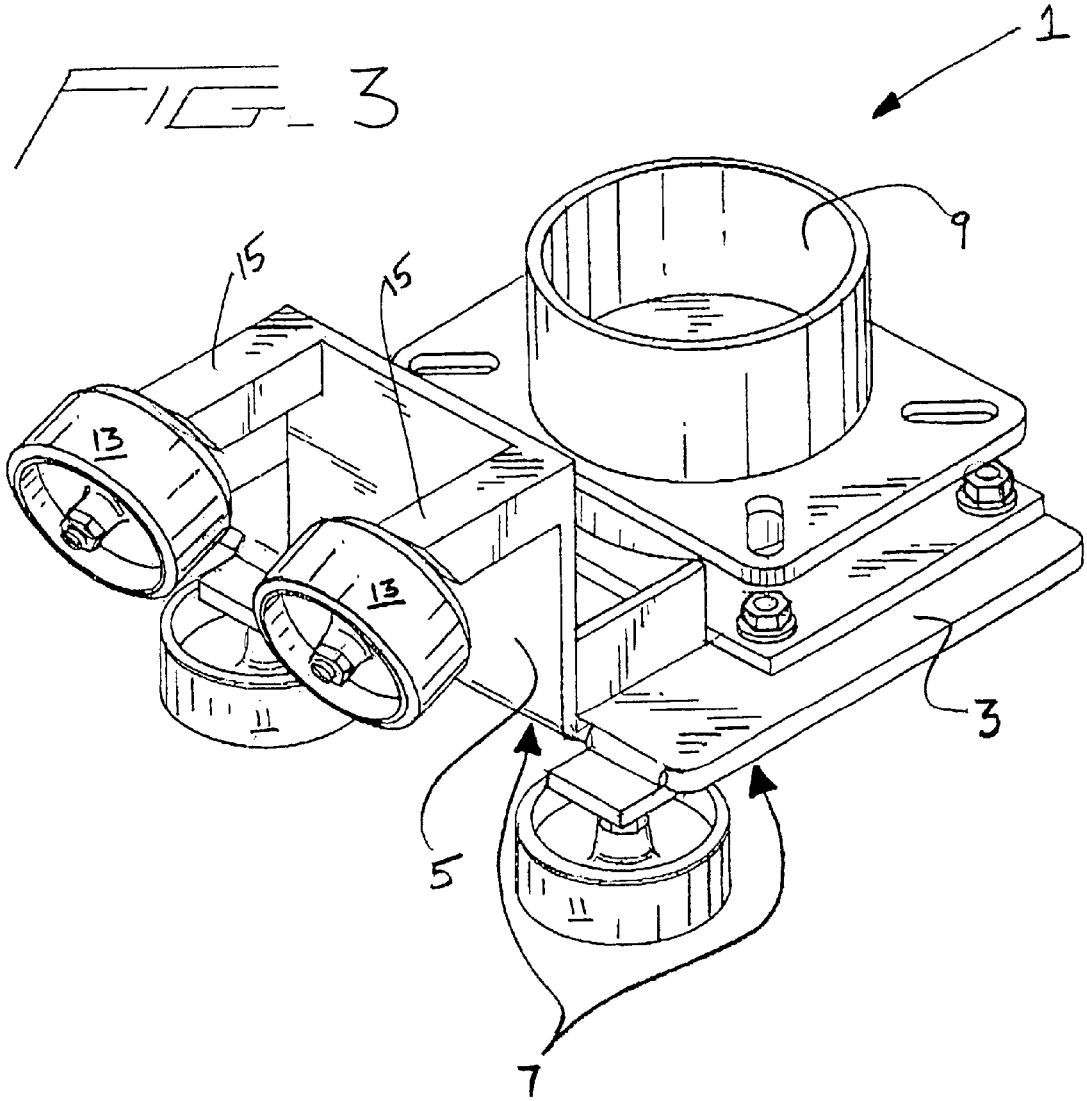

FIG. 3. is a three-dimensional view of one embodiment of a carriage apparatus according to the subject invention.

FIG. 4A is a side-view of the carriage apparatus of FIG. 3 shown in operation on a wall structure.

FIG. 4B is a side-view of an alternative embodiment of the carriage apparatus of FIG. 4A.

Figure 4C:
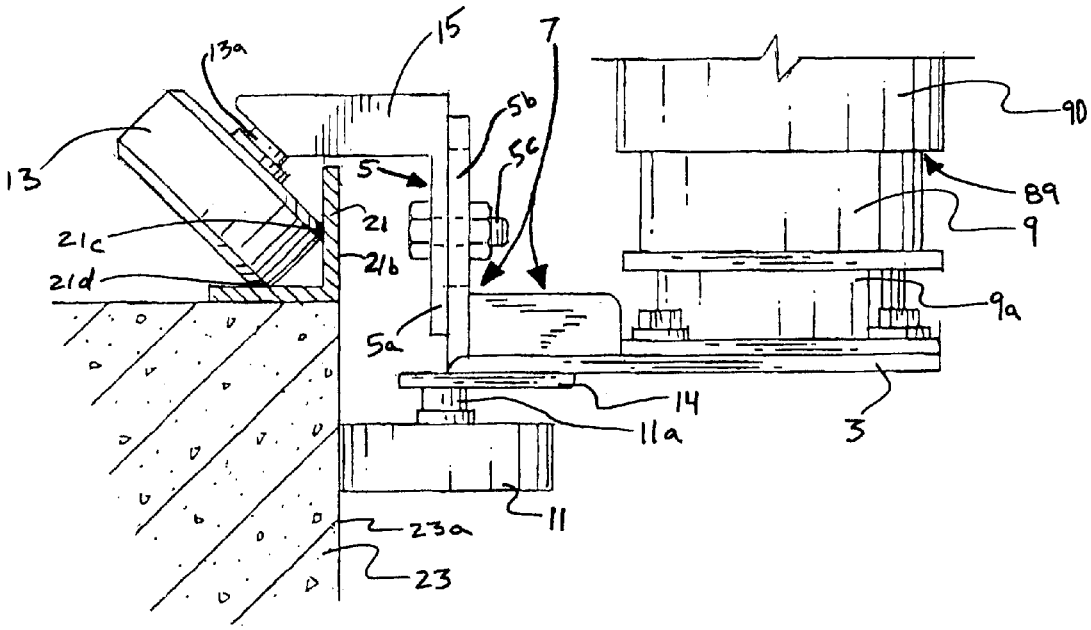

FIG. 4C is a side view of an alternative embodiment of the carriage apparatus of FIG. 4A.

Figure 5:
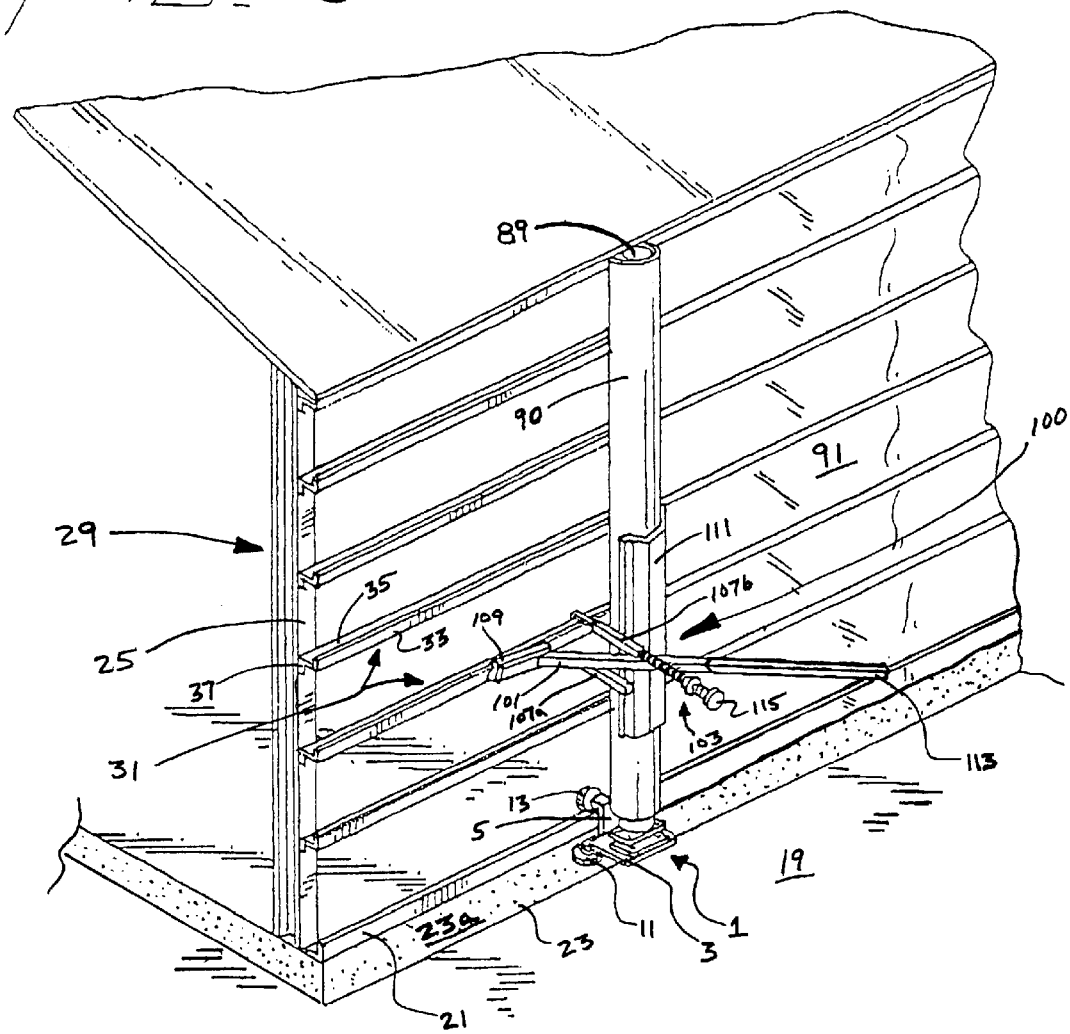

FIG. 5 is a is a three-dimensional view of the carriage apparatus of FIG. 3 shown in use dispensing fabric along a known wall structure.

DETAILED DESCRIPTION OF CERTAIN EMBODIMENTS

Figure 1:
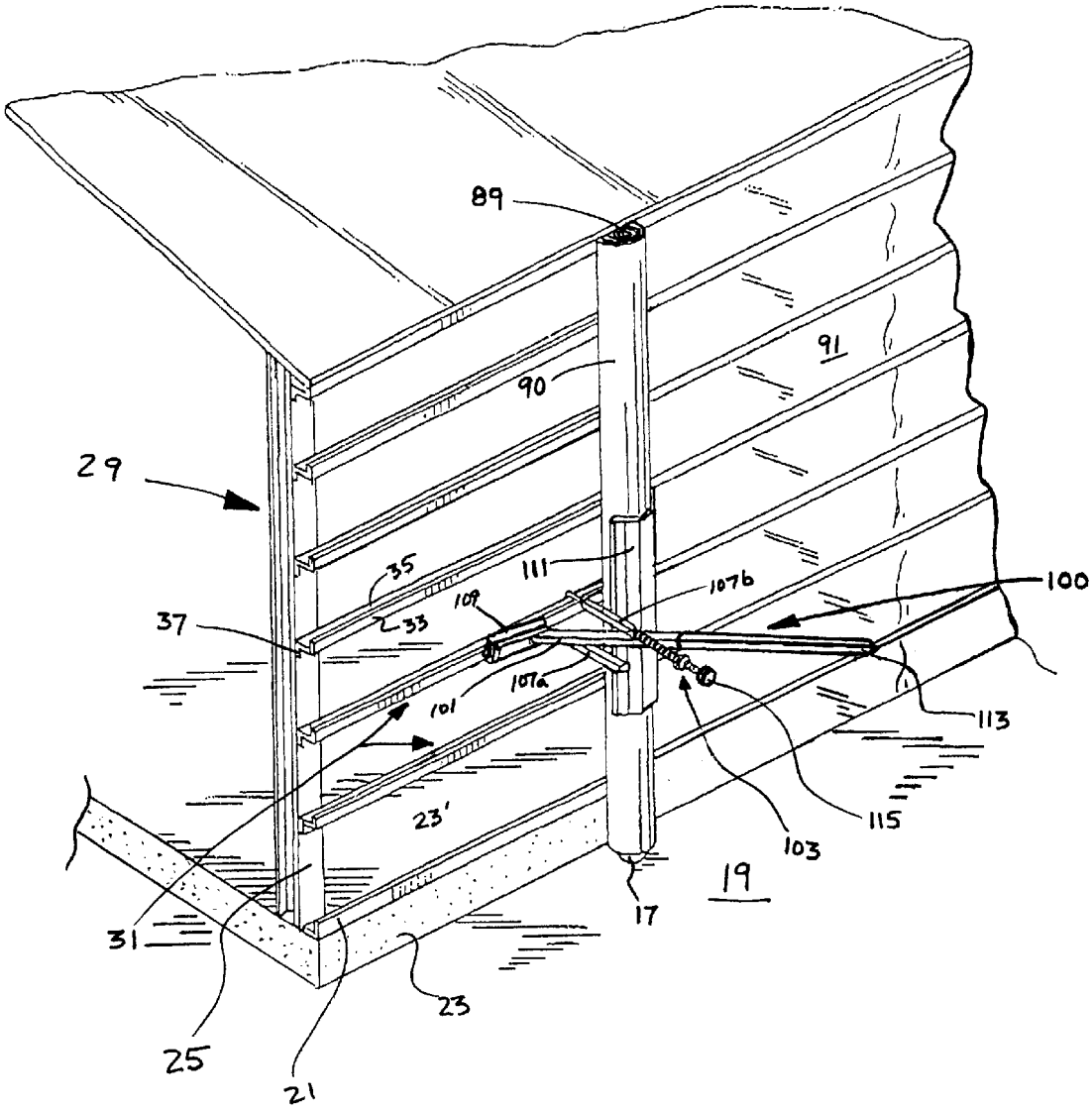
FIG. 1 PRIOR ART
FIG. 1 is three-dimensional view of a prior art dispenser employed dispensing a sheet of fabric along a known wall structure.

With reference first to FIG. 1, there is illustrated a conventional fabricated wall structure 29 in the process of being insulated utilizing a combination of known prior art apparatus. In particular, FIG. 1 illustrates a known rolled fabric dispenser 100 being utilized to dispense a vapor retarding fabric sheet 91 (along wall structure 29) from a roll of fabric 90. This fabric dispensing step, as previously described in the Background section above, is the first step in the insulated wall fabrication process. The remaining steps, as well as dispenser 100, are described in detail herein below but are more fully described in the aforementioned U.S. Pat. No. 6,308,489.

As previously described, wall 29 is generally comprised of a series of spaced, vertically extending columns (or studs) 25. These columns are set in foundation 23 typically several inches back from the edge of the foundation. Attached thereto are a plurality of horizontally disposed girts 31, each extending substantially parallel one to the other. These girts 31, as may be seen in FIG. 1, are the surface upon which fabric from fabric roll 90 will be dispensed. Each girt is typically comprised of a top flange 33, a bottom flange 37, and a web portion 35 extending between and connecting the two flanges. The distance between top flange 33 and bottom flange 37 is roughly equal to the distance columns 25 are usually set back from the edge of the foundation 23.

Further typically included in such a conventional wall structure, as aforedescribed, is base angle 21 which is normally "L" shaped with the base (horizontal portion) of the "L" being fixed flush against the top surface 23' of the (typically cement) foundation 23. The vertical portion of the "L" structure, as shown, is aligned with the vertical edge (or end) of the foundation. Although base angles come in a variety of dimensions, the base angle employed as illustrated is approximately 2 inches×2 inches.

In order to efficiently insulate such a fabricated wall structure as illustrated, dispenser 100 may be employed in known fashion to secure the rather long and heavy fabric roll 90 tight against the surface of the girts in a vertical position (FIG. 1). Use of dispenser 100 ensures that fabric (as sheet 91) may be dispensed in a manner so that the relative tautness or non-tautness of the sheet 91 may be controlled. Methods and uses for controlling the tautness or non-tautness of the insulated fabric are disclosed in detail in my co-pending U.S. Patent Application No. 09/511,306, filed Feb. 23, 2000, now U.S. Pat. No. 6,393,4897.

Figure 2:
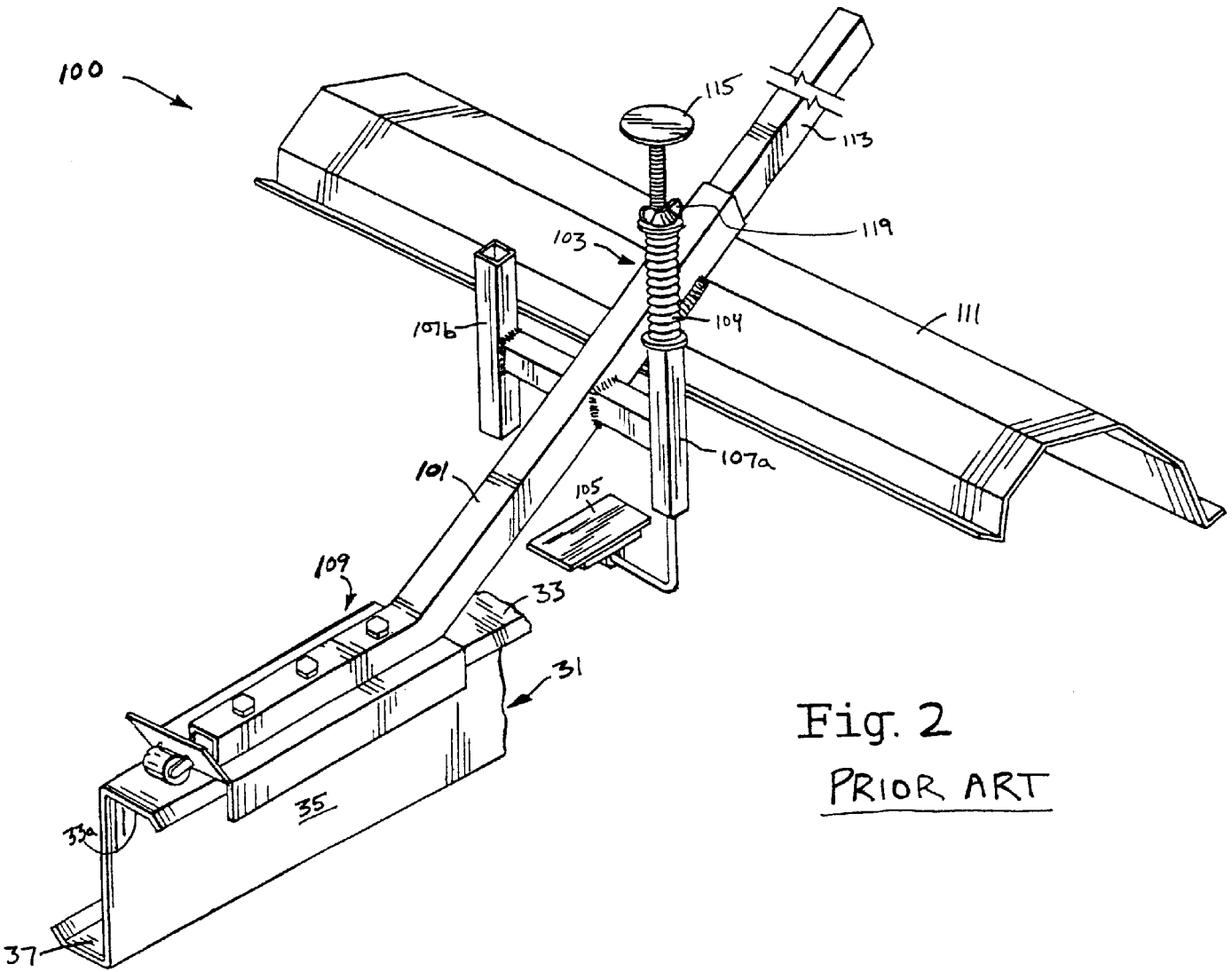
Fig. 2 PRIOR ART
FIG. 2 is a three-dimensional view of the prior art dispenser of FIG. 1.

Referring now to FIG. 2, dispenser 100 and its functionality are illustrated in more detail therein. As may be seen in this figure, dispenser 100 generally includes a frame member 101, a roll retention member 111 for holding a roll of fabric securely against a surface of girts 31, and a biasing mechanism 103 (including a coil spring 104 and glide plate 105) for securing the dispenser 100 to a surface of the wall structure and thus roll 90 via retention member 111. In particular, in order to set up dispenser 100 on a wall structure, guide mechanism 109 is placed over a girt 31 and push plate 115 is manipulated to orient glide plate 105 at the undersurface 33*a* of a girt top flange 33. So oriented, the force of coil spring 104 (resulting from its compression) is sufficient to maintain glide plate 105 in biasing engagement with undersurface 33*a* and thus secure dispenser 100 to the surface of the wall structure. As may also be seen in this figure, biasing mechanism 103 may be disassembled and reassembled in either of tubular arms 107*a* or 107*b* (via the removal of push plate 115 and wing nut 119), thus allowing dispenser 100 to be set up on any orientation of top flange 33 which is encountered.

As described in detail in the aforesaid co-pending application Ser. No. 09/511,306, dispenser 100 is useful for efficiently dispensing rolled fabric on both fabricated roof and wall structures. When employed to dispense fabric on a wall structure, however, dispenser 100 should ideally be used in combination with additional apparatus which is not subject to the aforementioned problems in the art. If such additional apparatus is not used, the end of the fabric roll 90 will drag on the ground 19 (and contact rocks and dirt, for example).

Turning now to FIGS. 3, 4A, 4B, 4C, & 5, there is illustrated apparatus which uniquely and efficiently overcomes the aforesaid drawbacks of the prior art. Specifically, carriage apparatus 1 (illustrated in these figures) solves the problems of the art by 1) supporting fabric roll 90 itself above ground level, and 2) by not contacting the ground itself and therefore not suffering the disadvantages associated therewith.

As illustrated in these figures, rolled fabric carriage apparatus 1 generally includes a frame 7 comprised of a first frame member 3, and a second frame member 5 extending vertically at an approximately 90 degree angle therefrom. Attached to first frame member 3 is rotatable carrying member 9 which, in the present embodiment, is generally cylindrical in shape. More particularly, in some embodiments carrying member 9 is preferably sized so that its outside diameter is slightly smaller than the inside diameter of core 89 of fabric roll 90 (see FIGS. 4A and 4C). This allows for carrying member 9 to be inserted into core 89 so that roll 90 will not shift unnecessarily when carried by carriage 1. In order that fabric roll 90 be capable of unrolling i.e. dispensing fabric as dispenser 100 is advanced along a wall structure, carrying member 9 is preferably rotatably attached to first frame member 3 via a rotatable attachment portion 9*a* and associated bearings (not shown). Carrying member 9 may, of course, take any variety of alternative forms so long as such forms permit carriage 1 to rotatably support a fabric roll.

Included as part of carriage apparatus 1 as means for attaching carriage 1 to a base angle 21 is a pair of first contacting members 11 and a pair of second contacting members 13. As seen in FIG. 4A, these contacting members are so oriented by their attachment, respectively, to first and second frame members 3 and 5 (via flanges 14 and arms 15) such that carriage apparatus 1 may be placed over the vertical portion of "L" shaped base angle 21 so that second contacting members 13 will contact surface 21*a* of the base angle, and first contacting members 11 will contact vertical surface 23*a* of the foundation (FIG. 4*a*). Abutting the respective surfaces of the base angle and foundation as such, first and second contacting members 11 and 13 effectively support carriage apparatus 1 at a predetermined height above ground level i.e. ground 19 (see FIG. 5).

In an alternative embodiment illustrated in FIG. 4B, first contacting members 11 may be so located so as to contact surface 21*b* of base angle 21 (e.g. if frame member 5 is of smaller dimensions for example). In a further alternative embodiment, illustrated in FIG. 4C, arms 15 may be of such a length such that contacting members 13 abut against surfaces 21*c* and 21*d* of the vertical and horizontal surfaces of the base angle respectively (i.e. between the angle formed by the vertical and horizontal members).

Contacting members 11 and 13 should be designed, of course, so that they allow carriage apparatus 1 to move unencumbered and smoothly along the perimeter of the wall structure via their engagement with base angle 21 and, in some embodiments, foundation 23. In this regard, in the embodiments illustrated in FIGS. 3, 4A, 4B, 4C, and 5, contacting members 11 and 13 are simply wheels attached to respective frame members 3 and 5 (by flanges 14 and arms 15) via rods 11*a* and 13*a* with associated bearings (not shown) to allow for rotatability. Alternatively, these wheels may be replaced by a low-friction plate, for example, or by any other suitable material or known structure which will allow carriage 1 to travel easily along base angle 21.

Referring again to FIG. 4C, in a still further alternative embodiment, frame member 5 is constructed so as to be adjustable in length. In particular, frame member 5 is made adjustable so that carriage apparatus 1 may be installed on a variety of base angles having varying dimensions. Rendering frame member 5 adjustable (in this embodiment) are frame member plates 5*a* and 5*b* which may be shifted up or down with respect to each other and a bolt 5*c* inserted therethrough (i.e. through apertures in each) to fix a particular frame member 5 length.

In the use of the subject invention, therefore, in order to efficiently and easily dispense fabric along a wall structure 29, carriage apparatus 1 may be employed by first placing it so that contacting members 13 engage surface 21*a* of the base angle (or in alternative embodiments surfaces 21*c* and 21*d*). Appropriately positioned, contacting members 11 should now be rested (as aforesaid) against surface 23*a* of the foundation, or, in other embodiments, surface 21*b* of the base angle (as shown in FIGS. 4A and 4B respectively). Once carriage apparatus 1 is correctly engaged with base angle 21 as such, a roll of fabric 90 may be loaded thereon. This may be accomplished by simply lifting a roll 90 and placing core 89 over rotatable carrying member 9 such that carrying member 9 inserts thereinto (see FIGS. 4A and 4C). Thereafter, in order to secure roll 90 tightly against girts 31, rolled fabric dispenser 100 may be employed by manipulating push plate 115 to orient glide plate 105 of biasing mechanism 103 behind a girt top flange 33. Dispenser 100 should be attached in a manner, of course, so that roll retaining member 111 is oriented over roll 90 and holds it firmly against the surface of the girts 31 via the force of coil spring 104 of biasing mechanism 103 (see FIG. 5). Before dispenser 100 is attached to secure roll 90, the roll may be manually held in place by another installer/worker.

It is noted here that the particular order of steps to mount a roll 90 upon a wall structure in preparation for fabric installation is not particularly important, and a roll 90 may be first loaded onto dispenser 100 and loaded onto carriage apparatus 1 thereafter if the installer desires. Furthermore, an installer need not employ the specific embodiment of dispenser 100 as illustrated in order to practice within the scope of the subject invention. As an alternative, any other embodiment of a rolled fabric dispenser may be employed, such as illustrated and described in U.S. Pat. No. 6,247,288 issued to Dan Harkins on Jun. 19, 2001, or no rolled fabric dispenser employed at all.

When utilizing dispenser 100, however, once a roll is loaded onto carriage apparatus 1 and dispenser 100 is in place on an appropriate girt 31, the fabric dispensing operation may be commenced. In particular, push pole 113 may be inserted into an end of frame 101 and utilized to advance dispenser 100 along the length of the wall surface (see FIG. 5). As dispenser 100 is pushed forward (after the trailing end of the fabric has been secured by conventional means such as with tape or adhesive), roll 90 will turn within roll retention member 111 allowing fabric to dispense as sheet 91 along the wall surface. Carriage apparatus 1, of course, carries the roll 90 above ground level 19 and along the wall length meanwhile allowing roll 90 to easily dispense sheet 91 via the rotatability of carrying member 9. Batts of insulation may then be placed over the layer of fabric 91 and metal sheeting fixed by screws or other mechanical means thereover.

Once given the above disclosure, many other features, modifications, and improvements will become apparent to the skilled artisan. Such other features, modifications, and improvements are therefore considered to be part of this invention, the scope of which is to be determined by the following claims:

I claim:

1. A carriage apparatus for carrying a roll of fabric as the roll of fabric is being dispensed along a wall structure, said carriage apparatus comprising:

a frame;

a carrying member connected to said frame which is so constructed and located such that it is capable of supporting a roll of fabric in a substantially vertical orientation at one end of the fabric roll;

at least a first wall engagement member connected to said frame and being rotatable about a first substantially vertical axis;

at least a second wall engagement member connected to said frame and being rotatable about a first substantially non-vertical axis;

wherein said first and second wall engagement members, in combination, are so located so as to be capable of cooperating with at least two surfaces of a wall structure such that said carriage apparatus will be moveably engaged to the wall structure.

2. The carriage apparatus according to claim 1 wherein said carrying member is rotatable about a second substantially vertical axis.

3. The carriage apparatus according to claim 2 wherein said second wall engagement member is laterally and vertically spaced from said first wall engagement member and wherein said first substantially non-vertical axis is oriented with respect to said first substantially vertical axis at an angle selected from between approximately 20–70 degrees.

4. The carriage apparatus according to claim 3 wherein said first wall engagement member has a contact surface so oriented such as to be engageable to a substantially vertical surface of a wall.

5. The carriage apparatus according to claim 4 wherein said first wall engagement member comprises a wheel.

6. The carriage apparatus according to claim 5 wherein said second wall engagement member comprises a wheel.

7. The carriage apparatus according to claim 6 wherein said carrying member comprises a cylindrical member so sized and shaped so as to fit within the end of a fabric roll core.

8. The carriage apparatus according to claim 7 further including a third wall engagement member located substantially adjacent to said second wall engagement member and being rotatable about a second substantially non-vertical axis which is oriented substantially co-parallel to said first substantially non-vertical axis.

9. The carriage apparatus according to claim 8 further including a fourth wall engagement member located substantially adjacent to said first wall engagement member and being rotatable about a third substantially vertical axis which is oriented substantially co-parallel to said first substantially vertical axis.

10. The carriage apparatus according to claims 8 or 9 wherein said third and fourth wall engagement members comprise wheels.

11. The carriage apparatus according to claim 10 wherein said frame comprises a substantially horizontal first frame member; and a second frame member connected at a first end to said first frame member at a first frame angle selected from between approximately 60–120 degrees; and wherein said carrying member is connected to said first frame member.

12. The carriage apparatus according to claim 11 wherein said frame further comprises a third frame member connected to a second end of said second frame member at a second frame angle selected from between approximately 60–120 degrees.

13. The carriage apparatus according to claim 12 wherein said third frame member comprises a pair of arms members and each arm member of said pair of arm members is connected to one of said second and third wall engagement members.

14. The carriage apparatus according to claim 13 wherein said first and fourth wall engagement members are connected to said first frame member.

15. The carriage apparatus according to claim 14 wherein said first substantially non-vertical axis is oriented with respect to said first substantially vertical axis at an angle selected from between approximately 30–60 degrees.

16. The carriage apparatus according to claim 15 wherein said first and second frame angles are each selected from between approximately 80–100 degrees.

17. The carriage apparatus according to claim 16 wherein said second frame member is adjustable in length thereby to vary a distance between at least two of said wall engagement members.

18. A carriage apparatus for carrying a roll of fabric as the roll of fabric is being dispensed along a wall structure, said carriage apparatus comprising:

a frame;

means for rotatably carrying a fabric roll in a substantially vertical orientation by supporting the fabric roll at an end thereof;

first means for engaging a wall surface connected to said frame;

second means for engaging a wall surface connected to said frame; and wherein said first and second means for engaging a wall surface, in combination, are so located and constructed so as to be capable of cooperating with at least two surfaces of a wall structure such that said carriage apparatus will be moveably engaged to the wall structure.

19. The carriage apparatus according to claim 18 wherein said first means for engaging a wall surface comprises a first pair of wheels, each wheel of said first pair of wheels being rotatable about a substantially vertical axis.

20. The carriage apparatus according to claim 19 wherein said second means for engaging a wall surface comprises a second pair of wheels, each wheel of said second pair of wheels being rotatable about an axis oriented at an angle with respect to vertical selected from between 30–60 degrees.

21. The carriage apparatus according to claim 20 wherein said frame comprises at least a first horizontal member having an upward facing surface and a downward facing surface;

said means for rotatably carrying a fabric roll being attached to said upward facing surface of said first horizontal member; and said first pair of wheels being attached to said downward facing surface of said first horizontal member.

22. The carriage apparatus according to claim 21 wherein said means for rotatably carrying a fabric roll comprises a rotatable cylinder so sized so as to fit within the end of a fabric roll core.

23. The carriage apparatus according to claim 22 wherein said second pair of wheels is located vertically spaced from said first pair of wheels and wherein a distance between said first pair of wheels and said second pair of wheels is adjustable by adjusting a length of a portion of said frame employing means for frame length adjustment.

* * * * *